United States Patent [19]

Buccola et al.

[11] Patent Number: 4,833,450

[45] Date of Patent: May 23, 1989

[54] FAULT DETECTION IN COMBINATION INTRUSION DETECTION SYSTEMS

[75] Inventors: Charles Buccola, Valley Stream; Lawrence M. Kolb, Whitestone, both of N.Y.

[73] Assignee: Napco Security Systems, Inc., Amityville, N.Y.

[21] Appl. No.: 182,213

[22] Filed: Apr. 15, 1988

[51] Int. Cl.[4] ..... G08B 13/18; G08B 13/24

[52] U.S. Cl. ..... 340/506; 340/522; 340/554; 340/567; 367/94

[58] Field of Search ..... 340/522, 554, 567, 587, 340/506, 511, 512, 513; 367/94

[56] References Cited

U.S. PATENT DOCUMENTS

| | | | |
|---|---|---|---|
| 3,725,888 | 4/1973 | Solomon | 340/522 |
| 3,727,216 | 4/1973 | Antonio | 340/554 |
| 3,801,978 | 4/1974 | Gershberg et al. | 340/522 |
| 4,243,979 | 1/1981 | Kleinschmidt | 340/554 |
| 4,275,390 | 6/1981 | Heywang et al. | 340/554 |
| 4,331,952 | 5/1982 | Galvin et al. | 340/522 |
| 4,401,976 | 8/1983 | Stadelmayr | 340/522 |
| 4,482,889 | 11/1984 | Tsuda et al. | 367/94 |
| 4,611,197 | 9/1986 | Sansky | 340/506 |
| 4,625,199 | 11/1986 | Pantus | 340/522 |
| 4,660,024 | 4/1987 | McMaster | 340/522 |
| 4,710,750 | 12/1987 | Johnson | 340/522 |

*Primary Examiner*—Glen R. Swann, III

*Attorney, Agent, or Firm*—Arthur L. Plevy

[57] ABSTRACT

An intrusion detection system employs a microwave subsystem and a passive infra-red subsystem. Both systems must produce an output signal indicative of an intrusion in order for the system to produce an alarm. There is disclosed a supervision circuit which monitors the number of trips of the microwave system as well as the number of trips of the PIR system. If the number of trips which are indicative of false alarms exceeds preset counts then an alarm is produced indicating that there is a failure in the microwave or the PIR system. The system further monitors the microwave system to determine whether the transmit and receiving diodes are functioning properly. The system will also indicate a fault if an intruder or an object is placed within a predetermined protection dome implemented by the system. Hence the system can produce multiple faults indicative of subsystem failures to notify the user of the system that such a failure has occurred.

15 Claims, 2 Drawing Sheets

FAULT DETECTION IN COMBINATION INTRUSION DETECTION SYSTEMS

BACKGROUND OF THE INVENTION

The present invention relates to intrusion detection systems of the type employing two detection technologies in one housing. More particularly, the invention relates to a supervision circuit to enable a user to determine the malfunctioning of either one of the technologies employed.

The prior art is replete with a number of systems which essentially are referred to as dual detection intruder systems. These systems utilize a pair of intruder detection subsystems, each functioning to detect intrusion by a technology different from the other. Upon the receipt of an alarm from both systems the user is warned of a valid intrusion.

In regard to such systems there have been many approaches which utilize combination systems such as microwave and passive infra-red, as well as other combinations. See for example U.S. Pat. No. 4,660,024 entitled "Dual Technology Intruder Detection Systems" by R. L. McMaster, issued on Apr. 21, 1987. In that patent there is shown the use of a dual technology intrusion detection system employing microwave and a passive infra-red (PIR) subsystem, both of which will provide an output upon the occurrence of a valid intrusion.

U.S. Pat. No. 3,801,978 issued on Apr. 2, 1974, entitled "Ultrasonic Microwave Doppler Intrusion Alarm System" to D. N. Gershberg et al. depicts a dual technology system which employs an ultrasonic and microwave subsystem in combination.

U.S. Pat. No. 4,625,199 issued on Nov. 25, 1986, to M. M. J. Pantus and entitled "Combination Intrusion Detector System Having Correlated Ultrasonic and Microwave Detection Sub-Systems, describes still another system utilizing ultrasonic and microwave systems in combination.

Thus it is clear that to provide intrusion detection systems with reliability the prior art has understood the need to utilize or combine two or more technologies in a common intruder detection system. See for example U.S. Pat. Nos. 3,725,888, 3,801,978, 4,243,979, 4,275,390, 4,331,952 and 4,401,976. These proposals go back many years but recently have received widespread use due to the fact that the cost of electronics has reached the level that enabled the commercialization of such systems.

In these systems the outputs of the different intruder detection subsystems, as for example microwave and passive infra-red subsystems, are fed to an output AND gate or its equivalent. In the event that the outputs of both subsystems indicate that an intrusion has been detected substantially simultaneously or within a given time interval then the AND gate provides the alarm activating signal. The advantage of such a system is that false alarms will only occur on relatively rare occasions where a spurious or false alarm-producing event is detected by both subsystems at about the same time. Hence, by combining diverse technologies the probability of false alarming is minimized.

In any event, as is known, a major drawback of a combination system resides in the fact that if one of the sensors or subsystems fails to operate properly the integrity of the entire system can be defeated. The prior art was cognizant of such problems and reference is made to U.S. Pat. No. 4,710,750 issued on Dec. 1, 1987, entitled "Fault Detecting Intrusion Detection Device" to R. A. Johnson.

In that patent there is described an improved intrusion detection system of the dual sensor type wherein one sensor is a PIR sensor and the other is a microwave sensor. The improvement comprises counting the detection of intrusion separately by the microwave sensor and by the passive infra-red sensor. Thereafter the counts by the two separate systems are compared and an indication is given if the number exceeds a certain user-selectable threshold to indicate a fault in one of the two sensor systems.

In any event, as one can ascertain from the above-noted patent, the difficulty that one can experience with this type of result is that the logic control means, which receives the outputs of the first and second systems, operates to compare numbers stored therein and outputs a false signal in response to this comparison. Hence, the comparison circuitry is relatively expensive and operates to provide user-selectable ratio numbers along input lines which ratio numbers are a function of the ratio of the microwave output with respect to the PIR output and vice verse. Hence, as indicated, this system is relatively expensive to produce and implement.

Certain of the prior art systems, as above described, also operate to determine faults in each of the dual technology systems in order to also indicate an alarm. Certain of these detection techniques are again difficult to implement and are basically unreliable. It is therefore an object of the present invention to provide a fault detector in a dual intrusion type detection system which is simple and economical to employ.

It is a further object of the present invention to provide a supervision circuit to enable the user of the system to determine failure of various system components to thereby also warn the user of a marginal condition.

BRIEF DESCRIPTION OF PREFERRED EMBODIMENT

In an intrusion detection system of the class employing dual technology subsystems, wherein a first subsystem provides a first output signal responsive to the detection of an intruder and wherein a second subsystem provides a second output responsive to the detection of an intruder and including means responsive to said first and second output signals for generating an alarm, the improvements therein comprising; first counting means for counting the number of said first output signals provided by said first subsystem and for providing an output signal ween said count exceeds a selected count, second counting means for counting the number of said second output signals provided by said second subsystem and for providing an output signal when said count exceeds a predetermined count less than said selected count, logic means coupled to said first and second counting means for generating an alarm signal for said output signal from said first or second counting means.

DETAILED DESCRIPTION OF FIGURES

Figure 1:
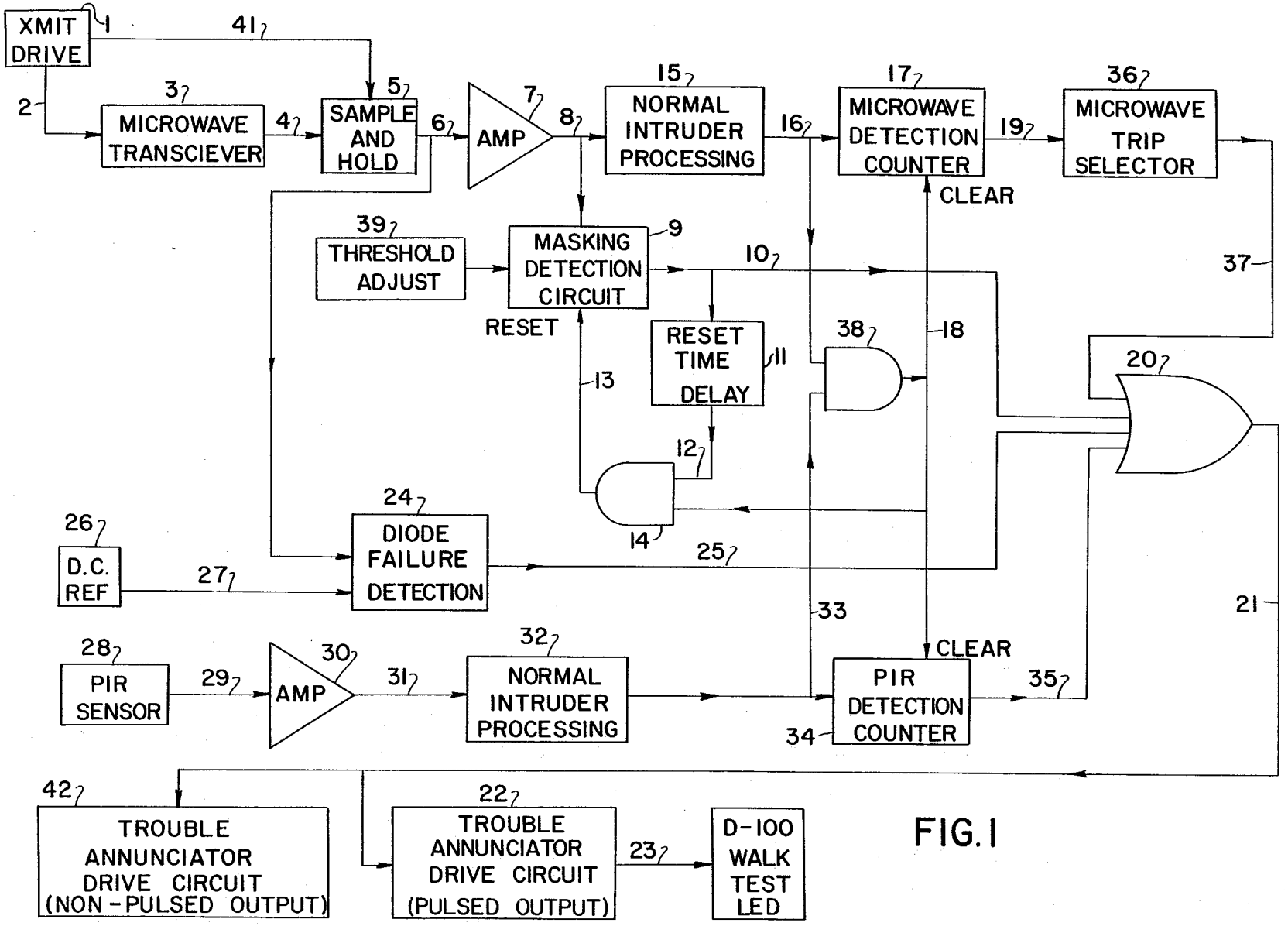
FIG. 1 is a detailed block diagram showing a full detection apparatus working in combination with a dual intrusion detection system.

Referring to FIG. 1 there is shown a detailed block diagram of the fault detection circuitry according to this invention. As will be understood, there are many intrusion detection systems which employ two detection technology. This technology is contained in a single housing. In order for the systems to operate, both technologies must detect an intruder simultaneously for an alarm condition to occur. If one detection technology is not functioning, an alarm cannot occur. If this condition exists the user should be alerted. The block diagram shown in FIG. 1 relates only to the fault detection circuitry and does not actually describe the actual intrusion modes. In any event there is shown in FIG. 1 a microwave transceiver 3. The microwave transceiver basically includes a Gunn diode for transmitting and a Schottky or other diode for receiving. The microwave transceiver is conventionally controlled by a transmit drive module 1 which is coupled thereto via a line 2. The output at the transmit drive module is coupled to the input of a sample and hold circuit 5 via line 41. The output of the microwave transceiver 3 is also coupled to the sample and hold circuit.

Essentially what occurs is that the microwave transceiver produces a pulse during the transmit mode. This pulse enables the sample and hold circuit and further enables the receiver portion of the microwave transceiver to receive a return pulse. If an intruder were present the return pulse would differ from the transmitted pulse due to the Doppler effect. This pulse is held in the sample and hold circuit and is subsequently directed to the amplifier 7 which is coupled to module 15 where normal intruder processing occurs.

In regard to this, normal intruder processing relates to the detection of the Doppler frequency or Doppler pulses which would be generated if an intruder is on the premises. The output from the microwave intruder processing circuit 15 is a pulse or a series of pulses and is applied via lead 16 to one input of a two-input AND gate 38. As will be explained, the AND gate 38 operates to clear the contents of a microwave detection counter 17 and a PIR or passive infra-red detection counter 34. The PIR detection counter 34 receives its signals from a PIR sensor 28 which has its output coupled to an amplifier 30. The output from amplifier 30 is coupled via lead 31 to a normal intruder processing circuit 32. The circuit 32 operates to determine whether or not a proper passive infra-red signal has been detected by means of the sensor 28.

The output of the normal intrusion processing circuit 32 is applied via lead 33 to the other input of AND gate 38. As one can see, the output of AND gate 38 serves to clear or reset both the microwave detection counter 17 and the PIR detection counter 34 as will be explained. The PIR output from the processing circuit 32 is connected to the clock input of the PIR detection counter 34 which is a decade counter.

In similar manner the output from the intruder processing circuit 15 is connected to the clock input of the microwave counter which is a 14-stage binary ripple counter. Each counter is incremented as each respective technology detects activity in its field of view. The same two outputs, as 16 and 33, are connected as indicated in AND fashion to the clear inputs of the two counters 17 and 34 in order to allow the counters to reset automatically to zero if both technologies trip simultaneously.

By choosing via a switch 36 which bit of the binary counter 17 one wishes to monitor, the user then has the capability of picking or selecting the number of independent microwave trips before a trouble signal is produced. The number of independent PIR trips is fixed at a given count level by monitoring the appropriate bit output of the decade counter 34. For example, the three output of the decade counter 34 is the count that would be monitored. In regard to the microwave detection counter 17 the user has the ability to select via a switch 36 any tap that he desires. This arrangement is selected because the microwave section will, under normal circumstances, produce far more trips than will the PIR section. Hence, the microwave counter 17 will count upwards more times than the PIR counter does.

In any event, as one can immediately ascertain, if the PIR counter 34 reaches a count of three this automatically indicates a fault. A fault is indicated via OR gate 20 which sends a high on line 21 to indicate this condition of circuit failure. As one can ascertain from FIG. 1, line 21 is coupled to modules 42 and 22 which essentially are trouble annunciators and can inform the user of the fault condition.

In the case of module 42, this is a non-pulse output which means that once module 42 is activated a continuous fault signal, such as a DC level, is supplied at the output. This DC level can be sent to a suitable control panel or monitoring station to indicate a fault.

In the case of module 22, when a high is on line 21 this module will produce a pulsed output in terms of an ON and OFF signal which may be indicated by means of a bulb or LED. As indicated, the module 22 is coupled via line 23 to a walk test LED. In such double intrusion detection systems, a walk test LED or lamp is employed to enable testing of the system once installed. In the case of a fault, as manifested at the output of OR gate 20, the trouble annunciator drive circuit 22 will cause the walk test LED to blink ON and OFF, thus alerting the user of a fault.

In addition, there are various other trouble signals which will also be produced and which will activate the OR gate 20. One such signal is produced if a person enters into a protection dome in an attempt to tamper with or mask the housing containing both intrusion systems.

As one will understand, the common housing which contains both systems is usually secured to a wall or other location. In this manner an intruder often will attempt to place a box, a screen or other device in front of the unit in order to block the unit from responding to movement in the room by preventing the transmission of the microwave or PIR signals. A dome of protection is created by taking advantage of the fourth order law of the microwave transducer 3. A person who comes too close to the unit will create a signal which is much larger than that of normal intrusion detection. Thus, the output of the microwave amplifier 7 is monitored by means of a masking detection circuit 9.

The masking detection circuit 9 is basically a conventional comparator. The threshold adjustment is afforded by means of potentiometer 39 which sets a predetermined threshold for the comparator in the masking detection circuit 9. The use of the threshold adjust or potentiometer 39 enables the user to control the range of the protection dome. Once the threshold is exceeded by a signal from amplifier 7 the comparator provides an output signal which is coupled via line 10 to an input of OR gate 20. At the same time a time delay 11 is set. The time delay 11 has an output coupled to one input of an AND gate 14 whose output serves to reset the circuit. Another input from AND gate 14 comes from the output of AND gate 38.

Once the threshold signal from the masking detection circuit 9 is exceeded and the trouble signal is produced, it cannot be reset until the reset time delay circuit 11 has expired. The length of this delay is approximately one minute. After one minute if both technologies are still functional and detects someone in the field of view the circuit will automatically reset itself via the output from gate 14.

A further trouble mode is available. As seen the output from the sample and hold circuit 5 is coupled to one input of a diode failure detection module 24. The module 24 again is a comparator and receives a threshold via lead 27 from a DC reference source 26. In this manner the microwave detector diode develops a DC bias from the incident RF generated by its own transmitter. Through the use of the comparator 24, this DC level is monitored and a trouble signal is provided if the level drops below the threshold level as set by the DC reference 26. Hence, the output of the diode failure detector 24 is coupled to OR gate 20 via another input. Through this arrangement the unit is able to insure that all transmitting, as well as receiving, diodes are working properly. All of the trouble signals produced by the circuits described above are connected in OR fashion via gate 20 to the trouble annunciator drive circuits 22 and 42. In the event of a trouble condition this circuit will cause the existing walk test LED associated with such intrusion devices to flash thus alerting the user. The auxiliary nonpulsed output from the trouble annunciator drive circuit 42 is also provided so that a trouble signal can be wired to the main alarm control panel through suitable driving circuitry.

Figure 2:
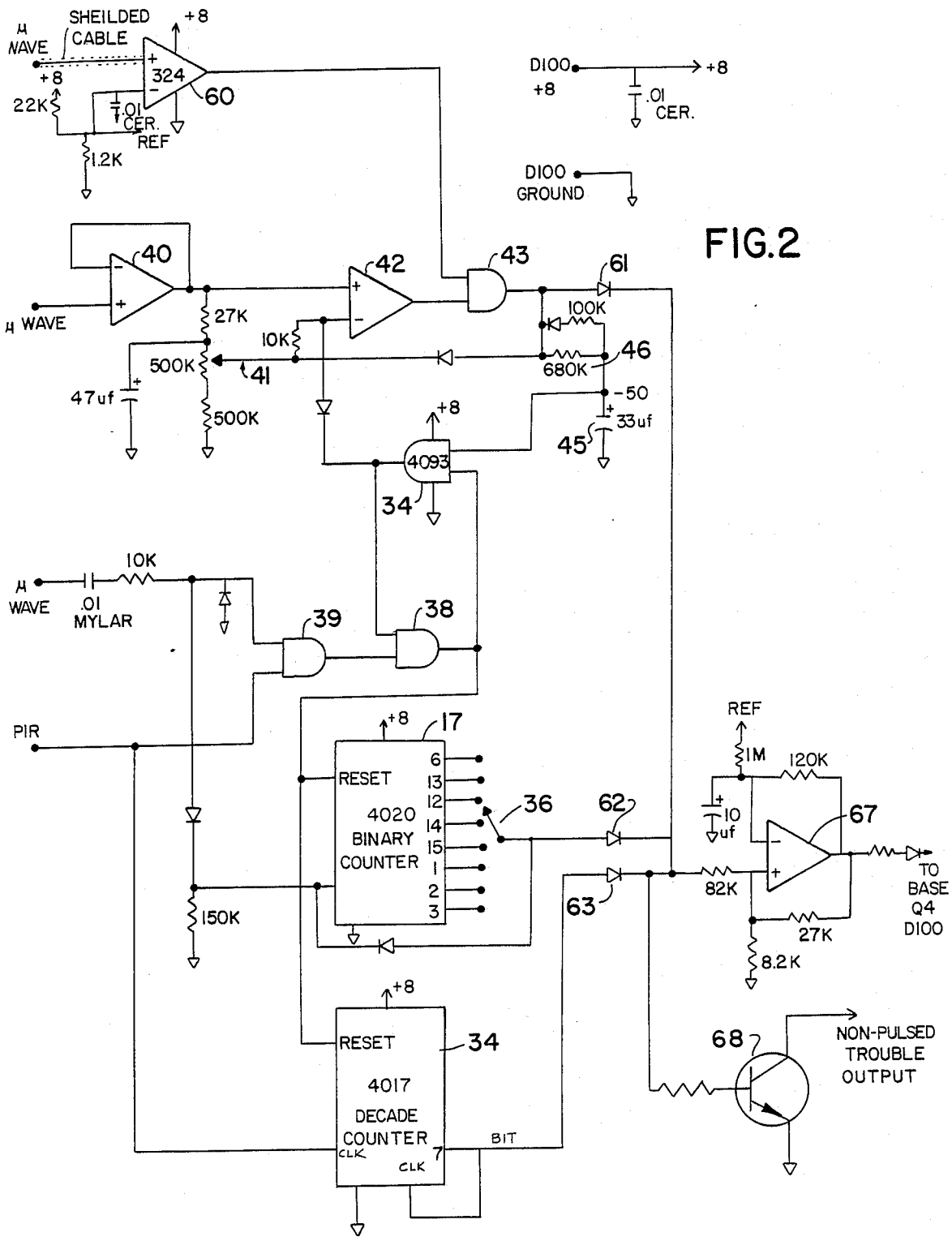
FIG. 2 is a detailed schematic diagram depicting the apparatus shown in FIG. 1.

Referring to FIG. 2 there is shown a circuit schematic implementing some of the above-described operations In FIG. 2 similar reference numerals as for example utilized in conjunction with FIG. 1 are employed to show similar 14 functioning components. As seen in FIG. 2, there is the binary counter 17 and a decade counter 34. The decade counter 34 receives its clock input from the PIR output or the PIR processing circuit 32 of FIG. 1. The binary counter 17 receives its clock input from the microwave output which is the intruder processing circuit 15 of the microwave section. Both counters 34 and 17 are reset by means of an output pulse from AND gate 38 and hence, as indicated, both counters will be reset when a signal is provided both from the microwave and the PIR sections. This reset is implemented by the AND gate 39 having its output coupled to one input of AND gate 38. The other input of AND gate 38 is at a high due to the bias from gate 34. In any event, gate 34 is analogous to gate 14 and when the output of gate 43 goes low a timing function is provided, as will be explained.

The masking detection circuit 9 of FIG. 1, with its associated threshold adjust 39 is shown in FIG. 2 and includes an input amplifier 40 having the microwave signal from amplifier 7 applied thereto. The output of amplifier 40 goes through a voltage divider, including a potentiometer 41 which potentiometer is used to set a threshold adjustment for a comparator 42. The comparator 42 has a given threshold set at the negative terminal and receives an input signal from the output of amplifier 40. If the output of amplifier 40 exceeds the threshold as set by potentiometer 41, the comparator 42 will provide an output. This output is provided via gate 43 which essentially causes a capacitor 45 to charge through resistor 46.

The charging of the capacitor will eventually cause the voltage at terminal 50 to reach a level whereby gate 34 will be energized. If at this time both the microwave and PIR systems operate simultaneously then, as indicated, gate 38 will cause the reset of comparator 42 via gate 34. As indicated, the level of the threshold is set via potentiometer 41, thus allowing the user the ability to determine the range of the protection dome. As seen, once a trouble signal is issued via amplifier 42, it cannot be reset for approximately 1 minute which is the time constant afforded by resistor 46 and capacitor 45. As indicated, if after one minute both technologies are still functional and detect someone in their field of view, the unit will automatically reset itself via gate 39.

Also, as indicated above, the microwave detector diode develops a DC bias from the incident RF generated by its own transmitter. This DC bias is applied to one input of the comparator 60. The comparator 60 has its other input coupled to a reference source. In any event, as explained above, through the use of this comparator the DC level, which is generated by the microwave diode, is compared in comparator 60. If the DC level drops below a set threshold, as determined by the voltage divider, then a trouble signal is developed. Through this arrangement one is able to insure that all transmitting, as well as receiving, diodes are working properly.

As further seen from the schematic, the output of comparator 60 goes to another input of NAND gate 43 which is coupled via a diode 61 to the input of a pulse circuit 67. In a similar manner the output of binary counter 17 is coupled via the switch 36 to a diode 62 and the output of the decade counter, which for example is the third bit, is coupled through a diode 63 which also goes to the circuit 67. It is thus seen that the diodes 61, 62 and 63 form an OR gate as the gate 20 of FIG. 1.

The circuit 67 includes an operational amplifier with suitable feedback to produce at the output of the operational amplifier a pulse signal. This signal is, as indicated, coupled to the walk test LED causing the walk test LED to flash ON and OFF. There is also shown a transistor 68 which produces a non-pulsed output as for example that obtained from module 42 of FIG. 1.

Thus FIG. 2 shows the simple circuitry which is employed to produce all the trouble conditions as specified in conjunction with FIG. 1. Thus, according to the above, it should be clear that four fault modes are detected by the supervision circuit shown in FIGS. 1 and 2. In this manner a microwave detection counter, which is a binary counter, is associated with a trip selector switch enabling a user to set the switch, as 36 of FIG. 2, to any desired binary output. This binary output will indicate a fault if the microwave section produces enough pulses, prior to a reset, to cause the binary counter 17 to reach the set state. The decade counter 34 produces an alarm when the passive infra-red or PIR input causes the decade counter to advance to the third bit. This alarm is produced via diode 63 of FIG. 2.

In another mode the amplitude of the microwave signal is monitored by means of a masking detection circuit 9 including a comparator. If this signal increases beyond a threshold set value then it is indicated that there is an intruder near the housing who may be attempting to block the same. This is a third trouble condition which is also the subject matter of fault. Further-more, the DC output produced by the microwave transmitter as rectified is monitored in another comparator and if this falls below a given threshold voltage then a fault is indicated again. This fault is indicative of the fact that the power output from the microwave oscillator is not sufficient to perform detection properly. Thus, as one can see from the above, the supervision circuit operates to monitor plural fault conditions in combination with an intrusion detection system employing dual technology such as both a microwave subsystem and a PIR subsystem.

What is claimed is:

1. In an intrusion detection system of the class employing dual technology subsystems, wherein a first subsystem provides a first output signal responsive to the detection of an intruder and wherein a second subsystem provides a second output responsive to the detection of an intruder and including means responsive to said first and second output signals for generating an alarm, the improvements therein comprising;

first counting means for counting the number of said first output signals provided by said first subsystem and for providing an output signal when said count equals a selected count, second counting means for counting the number of said second output signals provided by said second subsystem and for providing an output signal when said count equals a predetermined count, logic means coupled to said first and second counting means for generating a fault signal indicating a system malfunction for said output signal from said first or second counting means.

2. The system according to claim 1 wherein said first subsystem is a microwave intrusion detection system with said second subsystem being a passive infra-red intrusion detection system.

3. The system according to claim 1 wherein said first counting means is a binary counter having a plurality of outputs and including switching means for selecting any one output as said selected count.

4. The system according to claim 1 wherein said second counting means is a decade counter.

5. The system according to claim 1 including means coupled to said first and second counting means for resetting said counting means when said first and second output signals are simultaneously provided.

6. The system according to claim 2 further including means coupled to said microwave intrusion detection system for monitoring the magnitude of the microwave signal received by said subsystem and for comparing said magnitude with a given threshold level to provide an alarm output when said threshold is exceeded indicative of the presence of an intruder in close proximity to said intrusion detection system.

7. The system according to claim 6 further including means for varying said given threshold level to control the alarm output as a function of the distance of said intruder from said intrusion detection system.

8. The system according to claim 6 further including means coupled to said microwave intrusion detection system for providing a DC level according to the magnitude of a transmitted microwave signal and means for comparing said level with a reference level and means for producing a fault if said level falls below said threshold level.

9. In an intrusion detection system employing a microwave subsystem for transmitting a microwave signal and for receiving said signal to determine from said received signal the presence of an intruder according to the Doppler effect and to produce an output signal indicative thereof, and a passive infra-red system (PIR) for receiving infra-red radiation from an intruder and for providing an output signal indicative thereof, said system providing an alarm output for the presence of both output signals, the improvement therewith comprising;

first counting means for counting the number of output signals from said microwave subsystem and for providing a first signal when said count equals a selected count, second counting means for counting the number of output pulses from said passive infra-red subsystem and for providing a second signal when said count exceeds a preselected count, first means coupled to said microwave subsystem for monitoring the amplitude of said received signal against threshold signal and for providing a third signal when said received signal exceeds said threshold signal, second means coupled to said microwave subsystem for developing a DC level according to the magnitude of said transmitted signal and for comparing the DC level with a reference level and for providing a fourth output signal when said level falls below said reference level, and gating means responsive to said first, second, third and fourth signals for providing a fault output indicating a system malfunction for the receipt of any one of said signals.

10. The system according to claim 9 wherein said first counting means is a binary counter and including selector means for selecting a binary output indicative of said selected count.

11. The system according to claim 9 wherein said second counting means is a decade counter with said preselected count selected between 1-5.

12. The system according to claim 9 including means coupled to said gating means for providing a pulsed output for the presence of said alarm signal.

13. The intrusion detection system according to claim 9 further including means coupled to said first means for providing said third signal for a predetermined period.

14. The intrusion detection system according to claim 9 including means for varying the level of said threshold signal for comparison with said received signal.

15. The intrusion detection system according to claim 11 where said selected count is three.

* * * * *

Notice of Adverse Decisions in Interference

In Interference No. 102,401, involving Patent No. 4,833,450, C. Buccola and L. M. Kolb, FAULT DETECTION IN COMBINATION INTRUSION DETECTION SYSTEMS, final judgment adverse to the patentees was rendered Apr. 4, 1991, as to claims 1-15.

(*Official Gazette September 3, 1991.*)